US012623754B2

(12) United States Patent
Tabibi et al.

(10) Patent No.: US 12,623,754 B2
(45) Date of Patent: May 12, 2026

(54) SWIMMING KICKBOARD WITH ADJUSTABLE FLAP AND METHOD OF USE

(71) Applicants: Seena Tabibi, Menlo Park, CA (US); Nassim Banisaeed, Springfield, IL (US)

(72) Inventors: Seena Tabibi, Menlo Park, CA (US); Nassim Banisaeed, Springfield, IL (US)

( * ) Notice: Subject to any disclaimer, the term of this patent is extended or adjusted under 35 U.S.C. 154(b) by 46 days.

(21) Appl. No.: 18/508,487

(22) Filed: Nov. 14, 2023

(65) Prior Publication Data

US 2025/0153815 A1 May 15, 2025

(51) Int. Cl.
*B63B 32/64* (2020.01)
*B63B 32/20* (2020.01)

(52) U.S. Cl.
CPC ..... *B63B 32/64* (2020.02); *B63B 32/20* (2020.02)

(58) Field of Classification Search
CPC ..... B63B 32/64; B63B 32/20
See application file for complete search history.

(56) References Cited

U.S. PATENT DOCUMENTS 4,924,791 A * 5/1990 Scholle ..... B63B 32/64 114/363
9,394,036 B2 * 7/2016 Krietzman ..... B63B 32/60

FOREIGN PATENT DOCUMENTS

EP 0273989 A1 * 7/1998 ..... B63B 39/061
GB 2522394 A * 7/2015 ..... B63B 32/50

* cited by examiner

*Primary Examiner* — Marc Q Jimenez
*Assistant Examiner* — Jovon E Hayes
(74) *Attorney, Agent, or Firm* — PatentPC; Bao Tran

(57) ABSTRACT

A swim training apparatus in the form of a swimming kickboard with an adjustable flap. The base of the kickboard is constructed from a buoyant material, providing ample support to the user in water. The adjustable flap attached to the base is adjusted using a means that allows for the user to customize the flap's position between 0 and 90 degrees. This feature adds variation to workouts as it changes water resistance and buoyancy levels experienced by the user. A locking mechanism secures the adjustable flap at the chosen angle. Additional features may include an integrated handle in the buoyant base, a textured surface on the base for enhanced grip and the ability to detach the adjustable flap for easy maintenance or replacement. The method of use involves selecting the desired angle, properly securing it, and proceeding with the swimming or exercise session. It also provides the option of adjusting the angle during the swimming session and offering convenient storage with a flat or compact configuration.

19 Claims, 4 Drawing Sheets

SWIMMING KICKBOARD WITH ADJUSTABLE FLAP AND METHOD OF USE

BACKGROUND OF THE INVENTION

Swimming kickboards are commonly used training tools for swimmers to perfect their kicks and for water exercises. It allows swimmers to focus on their kicking technique and improve the strength of lower body muscles, particularly the legs. Traditional kickboards have a simple, flat design made from buoyant materials, and they serve to help the user float while they focus on their kicking technique.

Swim training and water workout routines often involve different types of movements and exercises. Therefore, the fixed design of conventional kickboards can be restrictive. There is a desire for more versatile swimming aids that offer the ability to adjust and modify their function to cater to the variety of needs and preferences of different users.

Furthermore, the typical kickboards are not always comfortable to use and may cause strain over time due to their one-size-fits-all design. A new kickboard design providing adjustable features would allow the user to customize the kickboard's orientation, thereby potentially improving comfort and effectiveness of swimming or exercising sessions in addition to challenging swimmers during different training sets.

Thus, an adjustable swimming kickboard is proposed to overcome these limitations, potentially maximizing the benefits attained from swim training or aquatic workouts. Further, this new design includes the ability to adjust the kickboard's angle, enhancing its functionality and offering more varied options for its user. Adjusting the angle can change the resistance and buoyancy, allowing for a more customizable workout.

SUMMARY OF THE INVENTION

A swim training apparatus in the form of a swimming kickboard with an adjustable flap. The base of the kickboard is constructed from a buoyant material, providing ample support to the user in water. The adjustable flap attached to the base is adjusted using a means that allows for the user to customize the flap's position between 0 and 90 degrees. This feature adds variation to workouts as it changes water resistance and buoyancy levels experienced by the user. A locking mechanism secures the adjustable flap at the chosen angle. Additional features may include an integrated handle in the buoyant base, a textured surface on the base for enhanced grip and the ability to detach the adjustable flap for easy maintenance or replacement. The method of use involves selecting the desired angle, properly securing it, and proceeding with the swimming or exercise session. It also provides the option of adjusting the angle during the swimming session and offering convenient storage with a flat or compact configuration.

Advantages of the invention may include one or more of the following:

1. Enhances water resistance and buoyancy levels during swimming sessions.
2. Allows for versatility of exercises with adjustable angle positions.
3. Offers convenient storage in a flat or compact configuration.
4. Provides an integrated handle in the buoyant base for easy handling.
5. Includes a textured surface on the base for enhanced grip.

6. Allows for easy maintenance, maneuvering, and replacement of the adjustable flap.

DETAILED DESCRIPTION OF THE INVENTION

Figure 1:
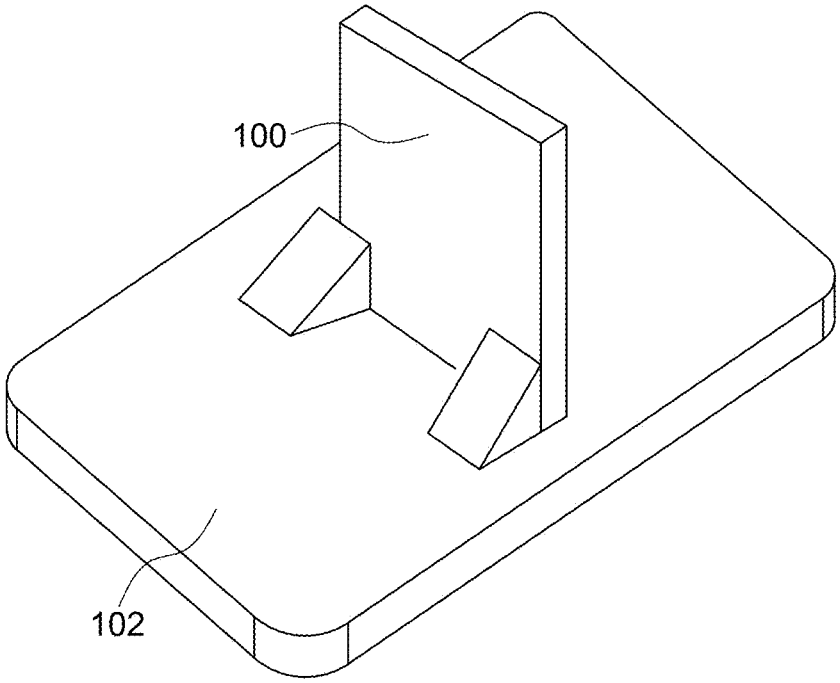
FIG. 1 shows a first embodiment of a kickboard with a water resistance flap.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

This invention now will be described more fully hereinafter with reference to the accompanying drawings, in which exemplary embodiments are shown. Various embodiments are now described with reference to the drawings, wherein such as reference numerals are used to refer to such elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the such as represent conceptual views or processes illustrating systems and methods embodying this invention. The functions of the various elements shown in the figures may be provided through the use of dedicated hardware as well as hardware capable of executing associated software. Similarly, any switches shown in the figures are conceptual only. Their function may be carried out through the operation of program logic, through dedicated logic, through the interaction of program control and dedicated logic, or even manually, the particular technique being selectable by the entity implementing this invention. Those of ordinary skill in the art further understand that the exemplary hardware, software, processes, methods, and/or operating systems described herein are for illustrative purposes and, thus, are not intended to be limited to any particular named manufacturer.

The present one embodiment pertains to a swimming kickboard apparatus that is intended to enhance the effectiveness of water workouts and swimming exercises. The proposed swimming kickboard features a buoyant base which is designed to provide user support. This base ensures that the user can remain in a forward-facing position on the water's surface, thereby facilitating exercises like kicking, swimming strokes, or general water acclimatization processes.

FIG. 1 shows a first embodiment of a kickboard with a water resistance flap 100. In this version, the flap 100 is securely attached to a base 102 of the kickboard at a perpendicular or 90 degree angle. The attachment can be done with a bracket holder, glue, screw, magnet, or any suitable securing mechanism. In this view, the bottom of the swimming pool faces the top 104 of the flap so that the top of the kickboard faces the sky and the flap faces the bottom of the swimming pool.

The flap shape can be altered depending on the purpose of the flap and the materials used. For example, if the flap is made from fabric, it could have a round or curved edge to give a more attractive look. The size of the flap will depend on the application and its intended use. Other examples can include but are not limited to the following shapes:

1. Wing Kickboard Flap: This kickboard flap is designed with an upward-facing wing shape to provide additional resistance and force the swimmer to kick harder while swimming.
2. Tapered Kickboard Flap: This kickboard flap has a tapered edge, which helps reduce drag and create more resistance in the water for the swimmer.
3. Wavy Kickboard Flap: This kickboard flap has a wavy edge that creates waves of resistance as the swimmer moves through the water.
4. Concave Kickboard Flap: This kickboard flap is designed with a concave surface that increases the surface area for greater resistance against the swimmer's movements.
5. Spiral Kickboard Flap: This kickboard flap has a spiral shape that creates a helix of resistance to help propel the swimmer forward.
6. Rectangular/Square Kickboard Flap: This kickboard flap has a rectangular or square shape that creates a solid wall of resistance.
7. Triangle Kickboard Flap: This kickboard flap has a triangular configuration offering a unique configuration of resistance, different from a rectangular or square shaped flap.

Figure 2:
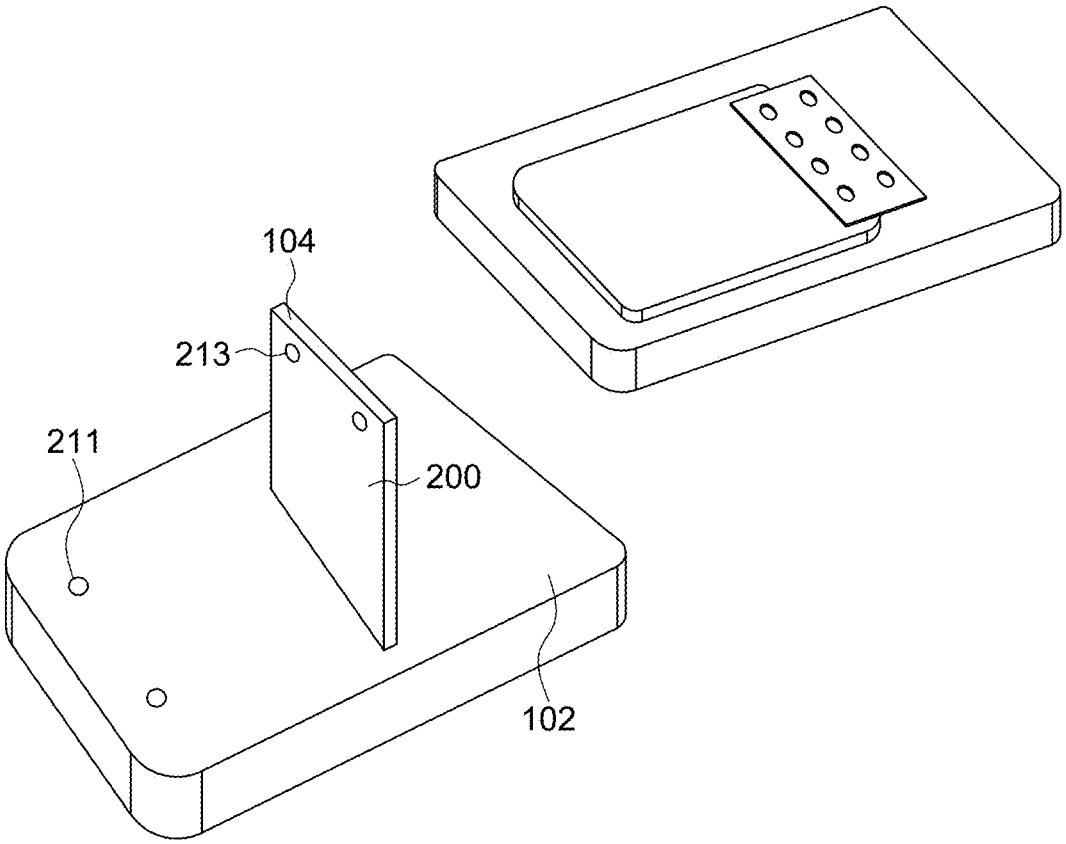
FIG. 2 shows a second embodiment of a kickboard with a water resistance flap.

FIG. 2A-2B show a second embodiment of a kickboard with a water resistance flap 200. In this version, the flap 200 is securely attached to a base 102 of the kickboard and to a hinge such as a piano hinge (continuous hinge). The embodiment allows for two dichotomous positions for the resistance flap 202: one situation shown in FIG. 2A allowing for the flap to lie flat at the base of the board, and another version shown in FIG. 2B where the flap is perpendicular (90 Degrees) to the base of the kickboard, providing maximum resistance for the swimmer. In FIGS. 2A-2B, the bottom of the swimming pool faces the top 104 of the flap. Further, as shown in FIG. 2B, the top of the flap 210 and its corresponding rest surface 212 on the kickboard can have magnets 211 and 213 or another secure attachment site to allow the flap to be magnetically secured to the bottom of the kickboard.

Figure 3:
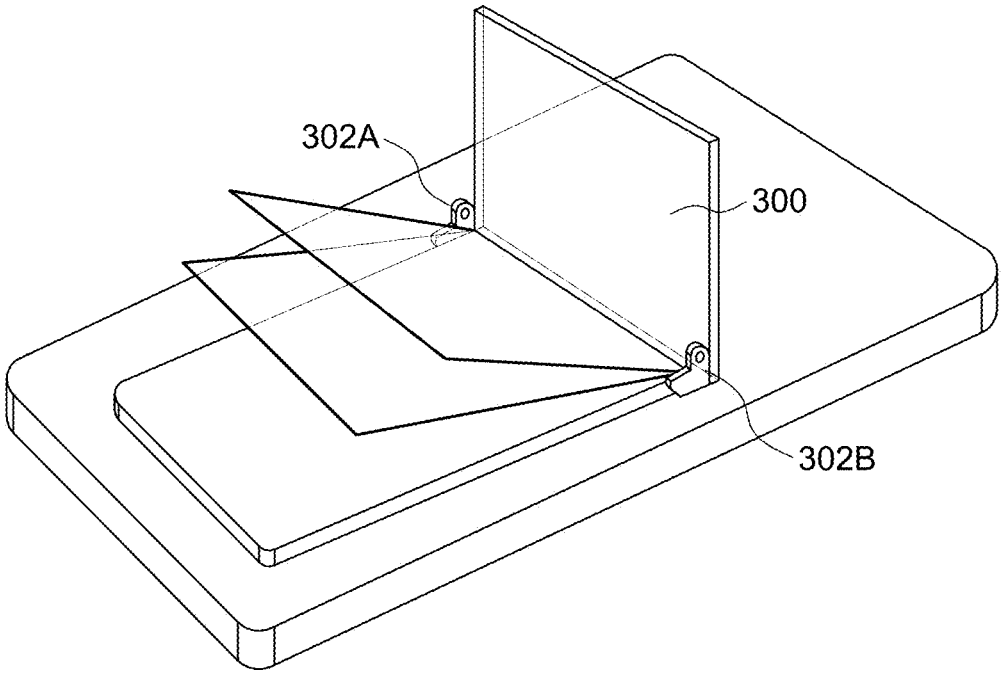
FIG. 3 shows a third embodiment of a kickboard with a water resistance flap.

FIG. 3 shows a third embodiment of a kickboard with a water resistance flap 300 mounted on flexible hinges 302A and 302B near the outer corners or peripheries of the bottom of the flap 300. While two flexible hinges are shown, additional flexible hinges can be used. In particular, the flexible hinges have multi-angle locking capability to allow users to vary the angle of the resistance flap 300 with respect to the kickboard base. For example, the resistance flap can be set between 0 and 90 degrees, thus varying the water resistance a swimmer experiences. In this view, the bottom of the swimming pool faces the top 304 of the flap.

Figure 4:
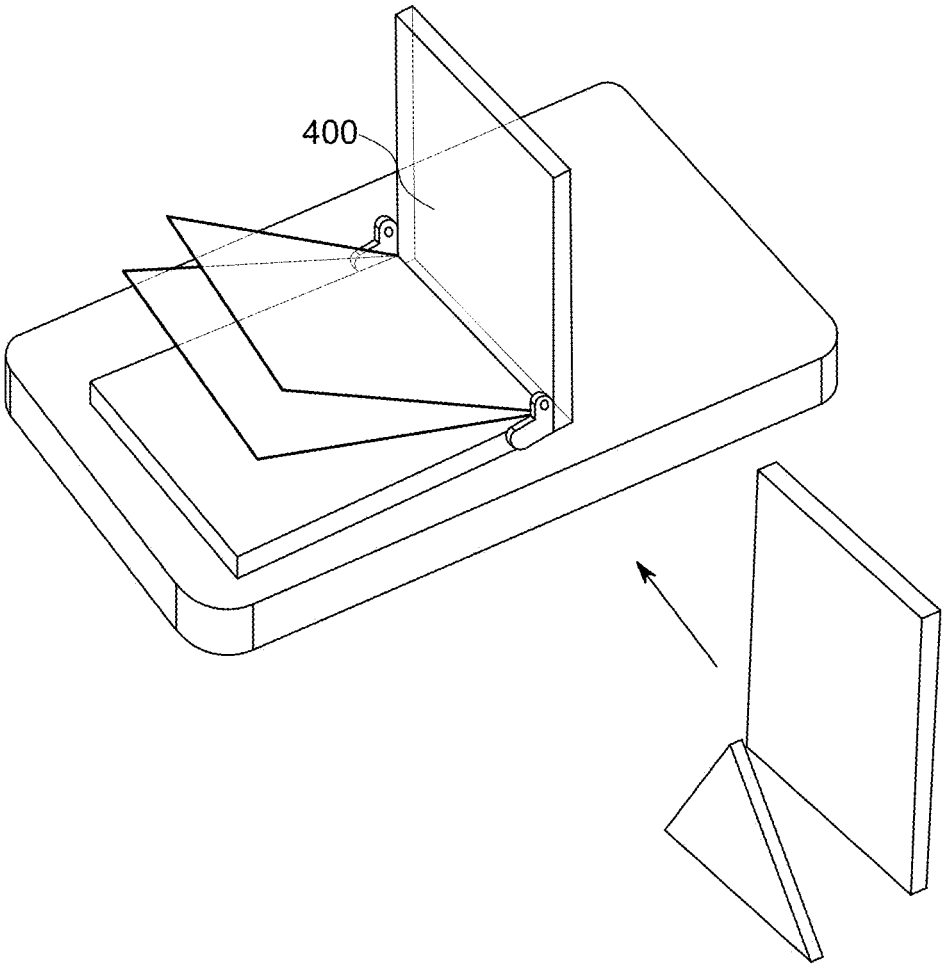
FIG. 4 shows a fourth embodiment of a kickboard with a water resistance flap.

FIG. 4 shows a fourth embodiment of a kickboard with a water resistance flap 400. In this version, in addition to the flexible hinges described above for FIG. 3, a groove is positioned on the base of the kickboard and the flap 400. In addition to the aforementioned features in the third embodiment, in the fourth embodiment, the flap can slide in and out of the groove, analogous but not limited to a tongue and groove fit and subsequent sliding mechanism with secure attachment to the kickboard base, allowing the user to choose when to attach or remove the flap to and from the kickboard, respectively.

The swimming kickboard contains the adjustable flap. The flap is secured to the buoyant base in a way that, when moved, can significantly alter the resistance encountered during a workout. The adjustable flap can be easily moved by the person using it while they are in the water, which provides a convenient way to vary the difficulty of the workout. This flap is made of sturdy yet flexible material that can withstand the stresses of repeated adjustments, water pressure, and swimming activities.

The one embodiment further boasts a mechanism for adjusting the angle of the flap with respect to the base of the kickboard. The user can make adjustments within a range of 0 degrees to 90 degrees, depending on the type and intensity of the workout desired. The 0-degree position provides the least amount of resistance, while the 90-degree position offers maximum resistance.

The mechanism is designed with user safety and ease of adjustment in mind. It incorporates a secure, efficient, and simple to use mechanism that allows the user to easily set the desired angle. This way, users can adjust the resistance levels on the kickboard to suit their specific needs, making it an ideal piece of equipment for people of varying fitness levels and swimming abilities.

Also incorporated is a means of securing the adjustable flap at the chosen angle. This feature allows the user to ensure that the flap stays at the desired angle during their exercise, so they do not have to worry about it inadvertently changing mid-workout. This securing device is durable and user-friendly, providing a reliable means of fixing the angle throughout the duration of the workout.

The unique combination of the buoyant base, adjustable flap, means of angle adjustment, and securing mechanisms make this swimming kickboard a versatile piece of swimming equipment. It may be used by beginners for water familiarization, intermediate users for stroke improvement, and by advanced swimmers for strength training.

Lastly, this patent covers a novel concept in swimming equipment, incorporating features that allow for a customizable, effective, and safe swimming workout. The swimming kickboard's user-friendly design makes it an advantageous and desirable tool for swimmers and fitness enthusiasts. This patent seeks protection for the unique design and components of this adaptable swimming kickboard.

The one embodiment relates to a kickboard, more specifically an advanced and innovative kickboard comprising an adjustable flap wherein the flap includes a rigid panel. The kickboard as described is essentially a flotation device, typically used for swimming or water-based fitness activities, designed to support the user's weight while they kick their legs to propel themselves forward. The unique feature of this kickboard, which sets it apart from conventional kickboards, is the incorporation of an adjustable flap with a rigid panel. This innovative design introduces a level of adjustability and control not previously found in ordinary models.

The adjustable flap, fabricated of a solid, tough material and characterized by a rigid panel, provides the users with the ability to modify and control the maneuverability, resistance, and buoyancy according to their specific needs, abilities, or the intensity of their workout. It operates on a mechanism that allows it to be adjusted to varying angles which alters the drag whilst swimming, thus adding to the versatility of the kickboard. The rigidity of the panel ensures its durability under the pressure generated by water and the user's weight while its adjustment renders the kickboard customizable to user's convenience or exercise regime. This rigid panel could possibly be constructed of materials such as ethylene-vinyl acetate (EVA), high density polyethylene (HDPE), other plastics, composite materials, or metal, ensuring the appropriate level of stiffness and resistance to water damage or corrosion.

In sum, the patented one embodiment relates to a creatively-engineered kickboard with an adjustable flap comprised of a rigid panel. By optimizing the adjustability of the flap, users can fine-tune their kickboard experience, effectively altering the degree of resistance, overall maneuverability, and buoyancy according to their unique requirements or desires. The rigid panel in the adjustable flap, tough against water resistance and user-generated pressure, guarantees long-lasting durability while providing a degree of customizability. The novel design thus truly revolutionizes the conventional use of kickboards, enhancing the user's swimming experience or workout intensity as they propel themselves forward in the water.

The present one embodiment relates to a kickboard comprising a base and an adjustably mounted flap pivotally attached to the base. Kickboards are commonly used as training devices for swimming, enhancing the swimmer's lower body strength and improving kicking techniques. Traditional kickboards are designed with a fixed shape and structure that may not suit all types of users or comply with their specific swimming styles. As such, the one embodiment provides a solution for this limitation through an adjustable flap connected to the base of the kickboard, thereby offering customized, optimized, and enhanced swimming training experiences.

More specifically, the core structure of this one embodiment comprises a traditional flat base, made of buoyant materials such as polystyrene or ethylene-vinyl acetate, to which an adjustable flap is connected. The flap is pivotally attached to the base via a hinge or similar mechanical fastening means. This pivotal connection grants the flap the ability to move, rotate, or tilt around the fixed point of attachment, primarily in a vertical plane. As such, the angle between the base of the kickboard and the flap can be adjusted to better suit individual swimmers' needs. For instance, a less experienced swimmer may opt for a nearly flat angle that offers stability, while a more experienced swimmer may prefer a greater angle that provides resistance for strengthening the lower body.

Further, the construction of the adjustable flap is designed to provide resistance in tune with the user's swimming pattern or preference. Adjustment can be made via manual alteration, be it directly by the user or via an attached control device. The adaptable attribute of the kickboard makes it highly versatile and suitable to cater to a wide range of training requirements and user preferences, thus transcending the limitations faced by conventional single-configuration kickboards. Additionally, the pivotal nature of the flap connection ensures the kickboard is durable, maintaining its functionality and integrity even after repeated modifications to the flap position. Overall, this one embodiment provides a novel, adaptable swimming training apparatus, significantly elevating the capabilities of conventional kickboards, and offering a more tailored and efficient approach to swimming training.

The present one embodiment pertains to an innovative kickboard design, specifically an adjustable flap equipped with an integrated locking mechanism that allows users to manually adjust the flap to their desired angle. The uniqueness of this one embodiment lies in its ability to accommodate a variety of user requirements and preferences, adding a customizable component beyond the typical fixed-design kickboard offerings in the market. This versatility supports enhanced comfort, superior performance, and improved maneuverablility.

Structurally, the adjustable flap is hingedly connected to the main body of the kickboard and can be rotated about the hinge to achieve the desired inclination. The locking mechanism associated with this feature provides secure fixation of the flap angle chosen by the user. Made from robust materials, the locking mechanism is able to withstand the pressure exerted by the user's weight and the water resistance during usage. The locking operation can be performed intuitively and easily, and once engaged, it holds the flap firmly in place, ensuring maintained stability in diverse conditions and different usage modes.

This unique adjustable and lockable flap function serves as a game-changing attribute, making the kickboard more user-friendly and functional. Depending on the user's preference, the adjusted angle can alter the kickboard's buoyancy and resistance in the water, leading to a tailored swimming experience. This is particularly advantageous for swim training, where different workouts may require different angles for maximum effectiveness. With the locking mechanism's secure hold, users can exercise with confidence knowing their selected angle will remain constant throughout their swim. Moreover, the user-friendly adaptation also means that it could be used across various experience levels, from beginner to professional athletes. In conclusion, the innovative combination of a versatile adjustable flap and a robust locking mechanism delivers a superior kickboard design for customized swim training.

The patent of the present one embodiment comprises of the kickboard that promotes enhanced buoyancy and stability in the water. This novel form includes a handle that is integrated into the buoyant base, thus facilitating easy handling and use by the end-user, while also preserving the integrity and structure of the kickboard itself. The integrated handle offers a robust grip that empowers the user's control over the tool for unobstructed maneuverability while afloat. It aids not only in moving the board but moreover to enhance the board's buoyancy by providing an ergonomic means to grip the board without compromising on base usability or floatation support.

The buoyant base of the board is designed to keep the users afloat in the water, and the integrated handle contributes significantly to maintaining direction and overall stability. The one embodiment's functional ergonomics is exquisitely defined with the handle playing a functional pivot that counters the aquatic resistance working against the user. Hence, the design intends to relieve the user of excessive physical straining and sudden shocks due to water ebb and flow. The handle incorporated into the buoyant base makes the firm gripping of the kickboard intrinsic to its use, preventing accidental slips or slides into the water.

The design of this patented kickboard respects both durability and user comfort, offering a worthwhile versatility during swims or training sessions. The incorporation of the handle into the buoyant base eliminates the need for external attachment, supports reducing parts susceptible to wear and tear, thus yielding a longer operational life to the product. The handle integrated into the buoyant base doesn't obstruct the floatation but enhances it by providing a balanced grip to hold and maneuver the board better. Therefore, the one embodiment provides extensive usability enabling a safer and more controlled aquatic experience.

The present one embodiment pertains to a kickboard, specifically designed with a textured surface on its base to enhance grip during use. The traditional design of kickboards often incorporates a smooth surface which, although providing ease of gliding on water, equally compromises the stability and control of the user. The major problem fundamentally resides in the reduced friction which the smooth surface presents, often leading to the risk of slipping or difficulty in maneuvering. Therefore, the one embodiment seeks to address these challenges by introducing a textured surface on the base of the kickboard.

The textured surface of the kickboard base, as per the one embodiment, is engineered with unevenness, prominences, and indentations to significantly boost friction during use. This surfacing strategy not only enhances the user's grip over the kickboard but also supplies a greater degree of traction, allowing for improved maneuverability and control in water. The textured surface assists in diminishing the risk of the kickboard slipping away from under the user, hence enhancing user safety. The texture may include patterns such as ribbed, grooved, or stippled arrangements, or any other textures that can efficiently increase frictional contact.

The one embodiment further includes a construction method for the textured base. It may involve the use of environmentally friendly, durable and water-resistant materials like rubber, plastic, or a composite. The uneven texture could be produced using methods such as embossing, engraving, or molding during the manufacturing process. The selected materials used not only lend greater resilience and longevity to the kickboard but also make it safe for all age groups. The width, depth, and pattern of the textures can be modulated based on the user's need and preference. With the aforementioned features, the kickboard with a textured base becomes a comfortable, safer, and user-friendly tool for swimming enthusiasts of all abilities and age groups.

The present one embodiment pertains to a kickboard specifically designed for providing enhanced navigational control while swimming or performing water sports. This type of kickboard, hereafter referred to as "The kickboard," incorporates an adjustable flap that lends a distinct advantage over conventional kickboards. The novelty of this one embodiment resides in the adjustable flap, which, unlike stationary or permanent designs, can be effortlessly adjusted by the user to meet specific physical demands and the desired level of resistance or propulsion in the water. The ability to modify the flap allows users to customize their exercise regimen, thereby optimizing performance and results.

The adjustable flap is not only easy to maneuver but also detachable, making this innovative kickboard much more convenient than traditional models on the market. This detachability feature serves two purposes. Firstly, it facilitates easy replacement-extending the life of the kickboard significantly. Users can simply replace the flap when it wears down or gets damaged, instead of discarding the whole kickboard. Secondly, this feature also aids in easy maintenance. With the ability to detach, clean, and reattach the flap, users can ensure their kickboard's longevity and optimal functioning in a cost-effective manner.

In summary, the kickboard revolutionizes the concept of a swimming aid. Its user-friendly and practical design, characterized by an adjustable, detachable flap, marks a significant advancement in the aquatic equipment industry. The customizable and maintainable features of this kickboard empower swimmers and water sports enthusiasts. It encourages them to individualize their equipment based on their preferences and maintain it efficiently. In this regard, the kickboard of claim 1 reaffirms the age-old wisdom that adaptability and maintainability are the key to prolonged usability, particularly in the realm of sports and fitness equipment. Consequently, the kickboard of claim 1 promises to be a reliable, versatile, and durable product that will contribute positively to the overall performance and fitness results of its users.

The present one embodiment pertains to swimming kickboards, specifically focusing on the utilization of an adjustable flap to vary resistance and buoyancy. Typically, kickboards are small flotation devices largely used in swimming for training purposes to improve the swimmer's kicking technique and strength. The distinctive feature introduced in this one embodiment is the concept of an adjustable flap which offers a range of 0 degrees to 90 degrees. This variable feature provides the user with the flexibility to select and secure their preferred angle, thus offering a more personalized and efficient swimming or exercise experience.

As commonly known, traditional swimming kickboards are typically flat and rigid. They are employed mainly to provide buoyancy, allowing the swimmer to stay afloat. However, their functionality does not extend beyond this feature. The innovation proposed in this one embodiment is the introduction of an adjustable flap which provides a magnitude of additional advantages. This adjustable flap can be manipulated to chosen angles, offering customizable resistance and buoyancy levels, hence, enhancing training effectiveness.

The user first selects their desired flap angle within a range of 0 degrees to 90 degrees. This adjustment can be made in accordance with the user's proficiency level, training goals or even personal preference. Once the angle is selected, the adjustable flap can be secured into place, locking it at the selected angle. This adjustable feature provides novel opportunities to change the resistance encountered during the swimming process, which is crucial for proficiency building and muscle strength.

In use, the kickboard is great for a range of different swimming and exercise sessions. The ability to adjust the flap angle provides varied resistance and buoyancy during exercise periods. This can prove beneficial for swimmers of all levels, starting from beginners who need more buoyancy and less resistance, to more advanced swimmers who could benefit from increased resistance to boost their performance.

Another important aspect of this one embodiment is the adjustable resistance feature. Adjusting the flap angle changes the water resistance experienced by the swimmer. This could be used for endurance training or for varying levels of strength training. By adjusting the angle to the maximum degree, it allows maximum resistance, providing a more challenging workout. As the swimmer progresses, the flap angle can be adjusted, thus gradually increasing the resistance to suit their improving capabilities.

Furthermore, the user's safety is maintained, as the adjusted angle does not affect the kickboard's buoyancy to the extent that it would cause the kickboard or the swimmer to submerge. In other words, regardless of the angle at which the flap is set, the kickboard will continue to provide a level of buoyancy sufficient to keep the swimmer afloat.

To summarize, the core of this one embodiment is implementing an adjustable flap on a kickboard that enables selectivity of different angles for varied resistance and buoyancy, providing opportunities for training customization. It allows for progressive adjustment to cater to swimmers as they improve, making it a highly adaptable and beneficial tool in the swimming and exercising realm.

This patent claims an embodiment related to an adjustable flap, which is adaptive, versatile, and innovative, designed for enhancing the experience of swimming or other water-based exercise sessions. The primary element, an adjustable flap, is integrated into a kickboard or other related swimming equipment, creating the opportunity to adjust swimming dynamics to compliment individual preferences and requirements. This one embodiment presents an improvement to existing swimwear and equipment, which typically only offer static performance, underscoring the significance of the adjustable feature.

Upon integrating this device into the swimming arena, the enhancement it brings is the adjustment mechanism that moderates the angle of the flap during the user's swimming or exercise session. Notably, this system allows the user to dynamically change the resistance encountered during the swimming process. The adjustment mechanism may be mechanical, electromechanical, or electronic, and allows real-time modification based on user preference or training requirements. This customization option opens up functionality beyond the typical expectations, accommodating different levels of swimmer strengths and goals, thus realizing a tailored swimming or training experience every time.

The patent one embodiment covers wide-ranging use scenarios from casual swimming to professional training. For the former, participants can adjust the flap for optimal comfort or enjoyment. For the latter, athletes can vary the flap's angle to create levels of resistance pertinent to particular training objectives, whether it be endurance, strength, or speed. Thus, this innovative technology not only enhances a swimmer's performance but also personalizes the experience. This adjustable flap system is a brilliant leap in swimming gear technology and presents a novel approach towards customized water-based workout regimes. Its viability extends beyond merely swimming into other water sports, making this patented one embodiment valuable within its domain and beyond.

The present one embodiment details a new and innovative design in kickboards that is characterized by the inclusion of an adjustable flap, extending the functionality of the device and broadening its at-large application. Conventional kickboards are typically bulky, cumbersome, and inconvenient to transport and store. This one embodiment addresses these issues by enabling the kickboard, inclusive of said adjustable flap, to be packed down into a flat or compact configuration. This unique feature allows for enhanced portability and storage, lending itself to efficient use in both personal and professional settings where space can be a premium.

The adjustable flap serves a dual purpose. Primarily, it increases the dynamic surface area of the kickboard thus allowing users to modify the resistance experienced when using the device. Consequently, this presents a revolutionary means of tailoring the swimmer's workout by creating variation in exertion levels. Secondly, when the adjustable flap is folded in, it seamlessly integrates with the kickboard's body, transforming it into a compact, flat piece. This innovative modification effectively reduces the profile of the kickboard, making it significantly easier to transport and store.

The one embodiment's design does not detract from the functionality or durability of a traditional kickboard, instead, it enhances it. High-quality materials and a robust construction ensure the kickboard's longevity, even with repeated folding and unfolding of the adjustable flap. The unique selling point of this one embodiment is the marriage of enhanced functionality with the convenience of portability and storage. As swimming continues to gain momentum as a preferred form of exercise, this patent encapsulates significant potential in addressing a gap in the market. It guarantees an improved user experience to swimmers, trainers, and swimming institutions alike by amalgamating the best of performance, practicality, and innovation.

The texture and the handle placement description are not meant to limit the manufacture of the kickboards to those specifications. For example, for texture, a smooth texture for the kickboard can be used, and the flap can be wood, or a material with a rougher texture. In addition to the types of material that can be used, in addition to PVC, EVA, HDPE, and others, the kickboard can be made from other material that are biofriendly and buoyant reusable including but not limited to wood, such as *Paulownia* wood. Furthermore, in terms of the handles for the kickboard, the handles can be placed on the sides, the front, the back, or perhaps even no handle for the kickboard thus the board can have a variety of the position of handles or their lack thereof. Further, while the range of angles of resistance of 0, 0 to 90 and 90 degrees, angles beyond 90 degrees to 180 degrees may offer a different type of resistance and that in addition to 0 degrees to 90 degrees, the user may also be able to achieve angles of resistance between 90 degrees to 180 degrees simply via rotating the kickboard 180 degrees in a horizontal plane (for example if the angle of resistance is 45 degrees with the kickboard base facing forward and the flap also facing forward with a 45 degree angle relative to the base, by rotating the kickboard around, a swimmer could hold the kickboard "in reverse" and have an angle of resistance of 135 degrees (180-45). Thus, the kickboard with 90 degrees to 180 degrees range of motion is equivalent to the described 0 degrees to 90 degrees. Of note, the flap is firmly positioned so that such a rotation would not result in external forces, such as water pressure, affecting the position of the flap if the kickboard is rotated 180 degrees.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. The various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical, or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects, and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the such as; the term "example" is used to provide exemplary instances of the item in discussion, not an exhaustive or limiting list thereof; the terms "a" or "an" should be read as meaning "at least one," "one or more" or the such as; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Hence, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other such as phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts, and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The invention claimed is:

1. A swimming kickboard, comprising:

a buoyant base designed for user support in water;

an adjustable flap attached to the base; and one or more hinges coupling the adjustable flap to the buoyant base, wherein the angle of the adjustable flap with respect to the kickboard base has a range of adjustability of 0 degrees to 90 degrees, offering varying degrees of resistance; and a handle integrated into the buoyant base.

2. The kickboard of claim 1, wherein the adjustable flap comprises a rigid panel.

3. The kickboard of claim 2, wherein the adjustable flap is pivotally attached to the base.

4. The kickboard of claim 3, wherein the means for adjusting the angle of the adjustable flap, may comprise a locking mechanism that secures the adjustable flap at the user-selected angle relative to the kickboard base.

5. The kickboard of claim 1, further comprising a textured surface on the base to enhance grip during use.

6. The kickboard of claim 1, wherein the adjustable flap is detachable and re-attachable including one of a tongue and groove fitting mechanism and subsequent sliding and secure attachment to the kickboard base-for easy use replacement, or maintenance.

7. The kickboard of claim 1, comprising a continuous hinge or a piano hinge to adjust a position of the adjustable flap.

8. The kickboard of claim 1, comprising corresponding magnets or other secure attachments on a base of the board and the flap to secure the adjustable flap to the board at a zero resistance setting.

9. The kickboard of claim 1, comprising flexible hinge(s) with multi-angle locking to adjust a position of the adjustable flap between 0 and ninety degrees (and including these two angles as well).

10. The kickboard of claim 1, wherein the base or the flap is textured or smooth.

11. The kickboard of claim 1, wherein the base or the flap comprises a material that is biofriendly, buoyant and reusable.

12. The kickboard of claim 1, wherein the base or the flap comprises wood, including but not limited to Paulownia wood, or other materials including but not limited to EVA, HDPE, PVC or other plastics.

13. A swimming kickboard, comprising:

a buoyant base designed for user support in water; and an adjustable flap attached to the base;

one or more hinges coupling the adjustable flap to the buoyant base, wherein the angle of the adjustable flap with respect to the kickboard base has a range of adjustability of 0 degrees to 90 degrees, offering varying degrees of resistance; and one or more handles placed on the sides, the front, the back of the base.

14. The kickboard of claim 1, wherein the flap is positioned relative to the base with a range of angles from 0 to 90 degrees.

15. The kickboard of claim 1, wherein the flap is positioned relative to the base with a range of angles from 90 to 180 degrees.

16. The kickboard of claim 1, wherein the flap is positioned relative to the base with a range of angles from 0 to 360 degrees.

17. A method of using a swimming kickboard with a buoyant base designed for user support in water; an adjustable flap attached to the base; one or more hinges coupling the adjustable flap to the buoyant base, wherein the angle of the adjustable flap with respect to the kickboard base has a range of adjustability of 0 degrees to 90 degrees, offering varying degrees of resistance; and a handle, comprising: selecting an angle for the adjustable flap of the kickboard at 0 degrees, at 90 degrees and within the range between 0 degrees to 90 degrees; securing the adjustable flap at the selected angle; using the kickboard in a swimming or exercise session to vary resistance and buoyancy.

18. The method of claim 17, further comprising adjusting the angle of the adjustable flap during the swimming or exercise session.

19. The method of claim 17, further comprising storing the kickboard with the adjustable flap in a flat or compact configuration.

* * * * *